US005460593A

United States Patent [19]

Mersky et al.

[11] Patent Number: 5,460,593

[45] Date of Patent: Oct. 24, 1995

[54] METHOD AND APPARATUS FOR IMPARTING LOW AMPLITUDE VIBRATIONS TO BONE AND SIMILAR HARD TISSUE

[75] Inventors: Barry Mersky, Rockville; Van P. Thompson, Riva, both of Md.

[73] Assignee: Audiodontics, Inc., Bethesda, Md.

[21] Appl. No.: 111,527

[22] Filed: Aug. 25, 1993

[51] Int. Cl.[6] ..... H04R 25/00

[52] U.S. Cl. ..... 600/25; 381/68.3; 607/55

[58] Field of Search ..... 600/25; 381/68–69.2, 381/151; 181/127, 128; 433/119; 607/50–57

[56] References Cited

U.S. PATENT DOCUMENTS

| | | | |
|---|---|---|---|
| 2,161,169 | 6/1939 | Jefferis, Jr. . | |
| 2,995,633 | 8/1961 | Puharich et al. . | |
| 3,594,514 | 7/1971 | Wingrove . | |
| 4,314,554 | 2/1982 | Greatbatch . | |
| 4,467,809 | 8/1984 | Brighton . | |
| 4,498,461 | 2/1985 | Hakansson . | |
| 4,606,329 | 8/1986 | Hough . | |
| 4,612,915 | 9/1986 | Hough et al. . | |
| 4,665,920 | 5/1987 | Campbell . | |
| 4,774,933 | 10/1988 | Hough et al. . | |
| 4,982,434 | 1/1991 | Lenhardt et al. . | |
| 5,033,999 | 7/1991 | Mersky . | |
| 5,190,456 | 3/1993 | Hasegawa | 433/118 |
| 5,318,502 | 6/1994 | Gilman | 600/25 |

*Primary Examiner*—Lee S. Cohen
*Assistant Examiner*—John P. Lacyk

[57] ABSTRACT

Vibrations for application to hard living tissue, such as bones, teeth, etc., are derived from a magnetostrictive element disposed in a varying electromagnetic field to create dimensional variations in the magnetostrictive element. In an audiodontic vibrator for the hearing impaired, a magnetostrictive rod is disposed in the hollow core of an electromagnetic coil through which current flows in response to acoustic signals. The resulting electromagnetic field in the core passes through the magnetostrictive rod, causing small dimensional variations in the rod corresponding to amplitude variations in the field. An actuator in contact with the rod extends from the housing and transmits the dimensional changes as low amplitude vibrations to the hard tissue via a bracket mounted on a tooth by an adhesive resin-based cement. The bracket has a receiving channel contoured to slidably and removably receive the distal end of the actuator in close fitting frictional relation. When secured to bone tissue the preferred cement is a non-ceramic hydroxyapatite cement. In either case, the applied vibrations create cyclical strain in the hard tissue.

18 Claims, 2 Drawing Sheets

METHOD AND APPARATUS FOR IMPARTING LOW AMPLITUDE VIBRATIONS TO BONE AND SIMILAR HARD TISSUE

BACKGROUND OF THE INVENTION

1. Technical Field

The present invention pertains to methods and apparatus for imparting low amplitude vibrations to hard tissue such as bone. The invention has utility in hearing aids, assistive listening devices, bone growth stimulation, various therapeutic applications, and the like.

2. Discussion of the Prior Art

It is well known that imparting acoustic frequency vibrations to the human skull, either directly or via teeth, results in improved hearing in certain hearing impaired individuals. Hearing aids and assistive listening devices taking advantage of this phenomenon generally include a microphone for transducing ambient acoustic energy into an electrical signal, an audio amplifier, a transducer for converting the amplified audio signal to mechanical vibrations, and some means of imparting the vibrations to a tooth or to bone structure in the skull. The vibrations ultimately stimulate the cochlea, resulting in a perception of sound. Examples of such devices are disclosed in U.S. Pat. Nos. 2,161,169 (Jefferis), 2,995,633 (Puharich), 3,594,514 (Wingrove), 4,498,461 (Hakansson), 4,606,329 (Hough), 4,612,915 (Hough), 4,774,933 (Hough) and 5,033,999 (Mersky). Ultrasonic vibratory transducers have been used to provide vibrations conducted via bone to organs other than the cochlea (e.g., the vestibular saccule) to effect sound perception in humans. An example of this approach is found in U.S. Pat. No. 4,982,434 (Lenhardt et al).

It is also known that mechanical stresses (e.g., in the form of vibrations) applied to bone tissue generate electrical potentials across the tissue, much like a piezoelectric effect. Further, it is known that when an elongate bone is subjected to a compressive force applied in the direction of its longitudinal axis, the periosteum is induced to proliferate and form new bone tissue. It is believed that this phenomenon is related to the electrical energy produced in the bone by its inherent piezoelectricity. It is also known that this phenomenon operates in a reverse manner, whereby application of alternating electrical current to living bone can produce mechanical deformation of the bone tissue.

Bone growth stimulators are disclosed in U.S. Pat. Nos. 4,314,554 (Greatbatch), 4,467,809 (Brighton) and 4,665,920 (Campbell) and typically utilize electrical current flow through bone tissue to effect bone tissue growth in the healing of fractures, for example. Although not so stated in these patents, it is postulated herein that the disclosed bone growth simulators actually induce vibrations in the bone tissue. Whether or not this is correct, these patents demonstrate the effectiveness of electrical stimulation of bone and suggest that direct application of vibrations to bone tissue produces electrical currents in the tissue, ostensibly via strain of the bone tissue and the resultant piezoelectric effect, to result in fracture healing and other therapeutic effects.

One of the problems associated with prior art attempts to apply vibrations to bones relates to the effectiveness of the vibrator itself to accurately transduce the applied electrical signals into mechanical vibrations. Another problem relates to the manner in which the transducer is coupled to the hard bone tissue. In particular, prior art coupling techniques have the disadvantages of: low coupling efficiency (i.e., significant loss of mechanical energy); deterioration of coupling efficiency over time; difficulty of removing or replacing the vibrating member; and a combination of these disadvantages. For example, reference is made to the aforementioned Hough patents and their disclosures of securing a bone vibrator to the skull either by bone screws, adhesive, or the like. These implanted vibrators respond to supracutaneously mounted electromagnetic transmitters delivering electromagnetic signals transcutaneously to the implanted vibrators. This transcutaneous, as opposed to direct, coupling of the signal to the vibrator results in considerable loss of energy since the energy loss between the transmitter and vibrator increases with the square of the distance between them. Moreover, the magnetic attraction between the transmitter and vibrator deteriorates over time and results in further loss of efficiency. As a practical manner, then, the implanted vibrator and external transmitter must be separated by only a thin layer of skin, and this layer must be so compressed between the members as to often result in pain for the wearer. Moreover, the compression of the skin results in edema, thereby further separating the transmitter and the vibrator and causing a further loss of transmission efficiency.

Many of the patents listed above disclose vibrating members relying on osseointegration to eventually secure the members to bone tissue. As a result, removal of the vibrator for replacement or for other reasons involves a major surgical procedure. Further, since osseointegration can only take place over time, such devices are impractical for use in fracture repair or other applications requiring immediate treatment.

Prior vibrators employed to impart vibrations to bone tissue are typically magnetic or piezoelectric. Magnetic transducers involve reciprocating translation of a magnetically permeable rod or similar armature member. These devices tend to be inefficient in transducing electrical energy into reciprocating translatory motion, and are operable only over limited frequency ranges due to inertial constraints of the movable member. Piezo-ceramic devices also tend to be inefficient in that they require relatively high voltages, and are notoriously ineffective at frequency ranges below 1 KHz.

OBJECTS AND SUMMARY OF THE INVENTION

It is an object of the present invention to provide an improved method and apparatus for efficiently imparting controllable, reproducible small amplitude vibrations to hard human tissue and/or adjacent tissue.

It is another object of the invention to provide an improved method and apparatus for attaching a vibrating device to hard tissue in order to effectively transduce electrical energy to mechanical energy at the coupling site.

A further object of the present invention is to provide a method and apparatus for efficiently coupling an electromechanical transducer to hard tissue, such as bone, teeth, etc., in a manner permitting the transducer to be readily removed and/or replaced.

It is also an object of the invention to provide a transducer for producing low levels of strain in hard tissue by converting electrical oscillations to low amplitude vibrations suitable for application to the tissue over a wide range of frequencies.

In accordance with one aspect of the present invention, a transducer for imparting low amplitude vibrations to create corresponding low levels of strain in hard tissue utilizes a highly magnetostrictive rod to which a cyclical magnetic field is applied to cause the rod to cyclically increase and decrease in length. Highly magnetostrictive alloys, such as TERFENOL-D, provide efficient conversion of electrical energy to mechanical energy over a wide range of frequencies extending from below 1 Hz to the high supersonic range. The resulting cyclical dimensional changes in the rod (as contrasted with translation or movement of the rod) create a cyclical force in a push-pull fashion that is efficiently imparted to hard tissue. The resulting forces can be utilized to effect conduction of acoustic waves for hearing enhancement, bone growth stimulation, strain in tissue, etc.

In a preferred embodiment of the invention the vibrations from the magnetostrictive rod are coupled to hard tissue via a precision connector secured to the tissue by means of a cement capable of transmitting the small amplitude vibrations to the bone without destruction of its adhesive properties. For applying the vibrations to teeth the preferred cement is Bis-GMA cement; for application to bone the preferred cement is non-ceramic hydroxyapatite cement having osseoconductive properties in the sense that it serves as a scaffold on which bone tissue is capable of growing. The precision connector is preferably a female connector to which a male connector on the magnetostrictive rod can be securely but removably attached. Thus, while the precision female connector is firmly secured to the hard tissue and may even osseointegrate with bone tissue, the transducer itself can be readily removed for replacement or other reasons without major bone surgery.

These and other objects, features and many of the attendant advantages of the present invention will be appreciated more readily as they become better understood from reading the following description considered in connection with the accompanying drawings wherein like parts of each of the several figures are identified by the same reference numerals.

DESCRIPTION OF THE PREFERRED EMBODIMENTS

Figure 1:
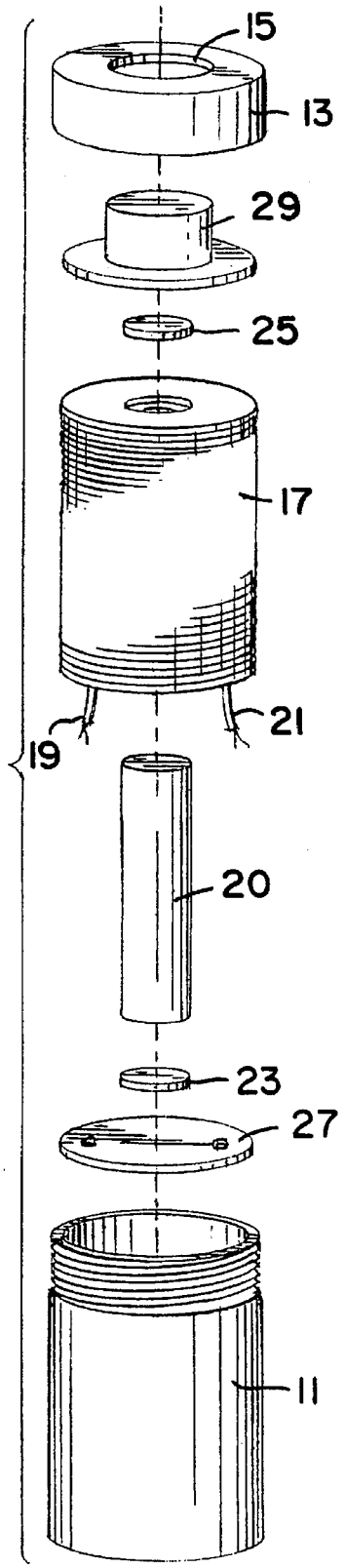
FIG. 1 is an exploded side view of a transducer constructed in accordance with the principals of the present invention.
Figure 2:
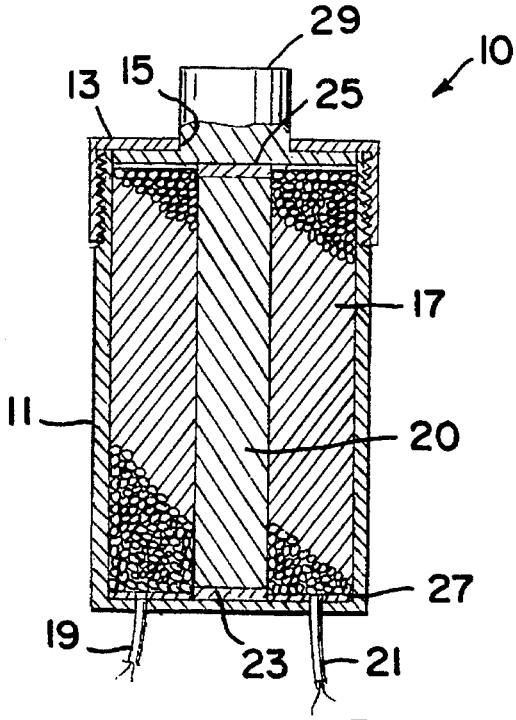
FIG. 2 is a side view in longitudinal section of the transducer of FIG. 1.

Referring specifically to FIGS. 1 and 2 of the accompanying drawings, a transducer 10 of the present invention preferably comprises a magnetically permeable container or housing 11 having a cylindrical configuration in the preferred embodiment. It is to be understood that while the cylindrical configuration has many practical advantages relating to manufacturing, conservation of space, etc., other housing configurations are possible. Further, although magnetic permeability helps concentrate the magnetic field in the magnetostrictive rod described below, in some cases it may be desirable to use materials that are not magnetically permeable. Container 11 is open at one end and its circumference is externally threaded at that end to engage an internally threaded endcap 13. The endcap is cup-like in configuration and has an aperture 15 defined centrally in its base. An electromagnetic coil 17, having a generally cylindrical configuration with a hollow core, is disposed symmetrically within housing 11 and occupies almost all of the space therein. In order to avoid electrically shorting the wires of coil 17 to the metal container 11, the coil wires are typically coated with a non-conducting resin, or the like. To the extent that any space may exist at the ends of coil 17 within the container, adhesive between the coil and the container may be employed to prevent relative movement between the two.

Two leads 19, 21 at opposite ends of the wire forming coil 17 extend out from housing 11 through suitably provided apertures defined in the closed housing end. A rod 20 of magnetostrictive material is disposed within the hollow core of coil 17 and is slightly shorter than the length of the core. Rod 20 is electrically insulated from core 17, either by annular spacing or by an insulative coating on one or both of the coil and rod. At opposite ends of rod 20 there are disposed respective generally disc-shaped permanent magnets 23, 25 to help concentrate the magnetic flux produced by coil 17 in rod 20. The diameters of magnets 23, 25 are smaller than the diameter of the core of coil 17 to permit the magnets to extend part way into the core. A magnetically permeable spring washer 27 is disposed at the closed end of housing 11 between magnet 23 and the housing end wall. At the opposite end of the housing, between magnet 25 and the inside surface of endcap 13, there is disposed a magnetically permeable vibration coupler 29. Coupler 29 has a circular flange portion disposed inside the housing and a centrally located longitudinally-extending segment projecting exteriorly of the housing through aperture 15 in the endcap. Once again, magnetic permeability is preferred for washer 27 and coupler 29, but such permeability is not necessary for all applications, depending upon how the magnetic flux is otherwise concentrated in rod 20.

The essence of the operation of transducer 10 is the magnetostrictive response of rod 20 to alternating electrical current passing through coil 17. Specifically, current through coil 17, in a conventional manner, creates a magnetic field passing through the coil core and extending around the coil exterior from one end of the core to the other. The field portion within the core passes through the magnetostrictive rod. As the polarity of the actuating current changes, the direction of the field likewise changes. The varying magnetic field is thus induced in the magnetostrictive rod 20, causing the rod to alternately shrink in length and then grow in length at the frequency of the magnetostrictive field variation and, therefore, at the frequency of the electrical current passing through coil 17. This alternating dimensional variation of rod 20, as opposed to linear translation of an armature, results in vibrations at the same frequency being induced in coupler 29. From the coupler, these vibrations can be applied to hard bone tissue, teeth, etc., in a manner described hereinbelow.

Importantly, the small dimensional variations are created in rod 20 using much lower electrical power levels than would be required in vibrations requiring translational movement of a magnetically permeable rod disposed within the core of coil 17. Specifically, a magnetically permeable rod has a finite mass and develops significant inertia while being reciprocated. On the other hand, the dimensional changes created in the magnetostrictive rod 20 require significantly less energy and lower currents.

The preferred magnetostrictive material for rod 20 is

Terfenol, a compound of terbium and iron represented as $TbFe_2$. A particularly useful form of Terfenol for this purpose is TERFENOL-D, a compound also including dysprosium and represented by $Tb_{.27}Dy_{.73}Fe_2$. TERFENOL-D has a rapid response time to magnetic field changes, exhibiting as much as a 0.2 percent change in length (i.e., "low amplitude" vibration) within microseconds of an applied electromagnetic field. Other magnetostrictive materials are, of course, useful for rod 20.

The magnetic field created through rod 20 by current flowing in winding 17 is returned through the coupler 29, endcap 13 and container 11, all preferably made of magnetically permeable material. This magnetically permeable return path concentrates the magnetic field and increases the efficiency of converting the electrical power to magnetostrictive vibrations. Permanent disc magnets 23, 25 serve to bias the magnetic field in a conventional manner to avoid the need to provide electromagnetic biasing. The strength and size of these magnets can vary as necessary to achieve the desired bias level and more effectively concentrate magnetic flux in the rod.

Endcap 13 is preferably made of the same magnetically permeable material as container 11 and serves to hermetically seal the container against bodily fluids. The exterior of the container and endcap may be coated with a biologically compatible polymer, depending upon the site of the transducer when in use. From an immunological standpoint, therefore, the transducer appears inert. The sizes of the components are also dependent on the location and use of the device. For example, an audiodontic transducer utilized to transmit acoustic frequency vibrations to teeth may have a length for container 11 on the order of 8 mm and an outside container diameter on the order of 4.5 mm. A Terfenol rod 20 with a length on the order of 5.0 mm and a diameter on the order of 1.5 mm would be appropriate in such a device.

The thickness and material composition of spring washer 27 are chosen to define the resonate frequency of the transducer. The washer mechanically stresses rod 20 by compressing it axially toward the endcap, thereby permitting the output characteristic of the transducer to be altered by this compression force without altering other components such as the size or mass of container 11. For example, a particular size and shape of the transducer may be suitable for the attachment site but may result in a natural resonant frequency higher than desirable for the particular application. Changing washer 27 changes the mechanical stress on the rod and, thereby, the resonant frequency. This is particularly advantageous where all models of a particular type of transducer are desirably packaged in the same size and shape container, but each model most efficiently operates at a different resonant frequency.

Figure 3:
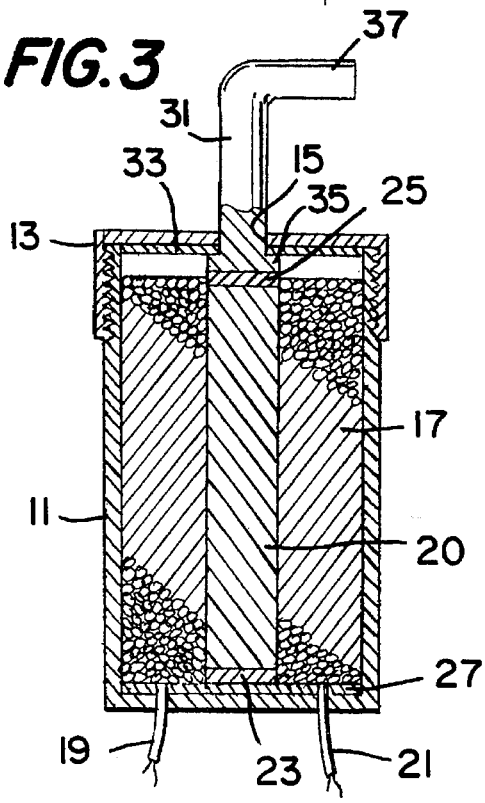
FIG. 3 is a side view in section of a modified version of the transducer of the present invention.

A modified transducer 30 of the present invention is illustrated in FIG. 3 wherein like reference numerals are utilized to identify like parts in the embodiment of FIG. 1. Transducer 30 differs from transducer 10 in that vibration coupler 29 is replaced by a driving rod 31, and an additional spring washer 33 is disposed annularly about rod 31 at a location adjacent the interior surface of endcap 13. Specifically, driving rod 31 has an annular flange 35 at its proximal end inside container 11. Spring washer 33 has an annular configuration with a central hole having a smaller diameter than flange 35 to thereby trap the proximal end of the rod inside housing 11. The intermediate portion of rod 31 extends externally of housing 11 through hole 15 and endcap 13. At its distal end 37, rod 31 is bent and contoured in the manner described below to be slidably received in a receiving bracket at the hard tissue attachment site.

The rearward facing surface of flange 35 abuts magnet 25 which, in turn, abuts magnetostrictive rod 20. Accordingly, magnetostrictively induced dimensional changes in rod 20 impart vibrations to rod 31 for application to a hard tissue site.

Spring washer 33 provides an additional capability for applying selected compression to magnetostrictive rod 20 to thereby provide more control over the resonant frequency of the transducer.

Figure 4:
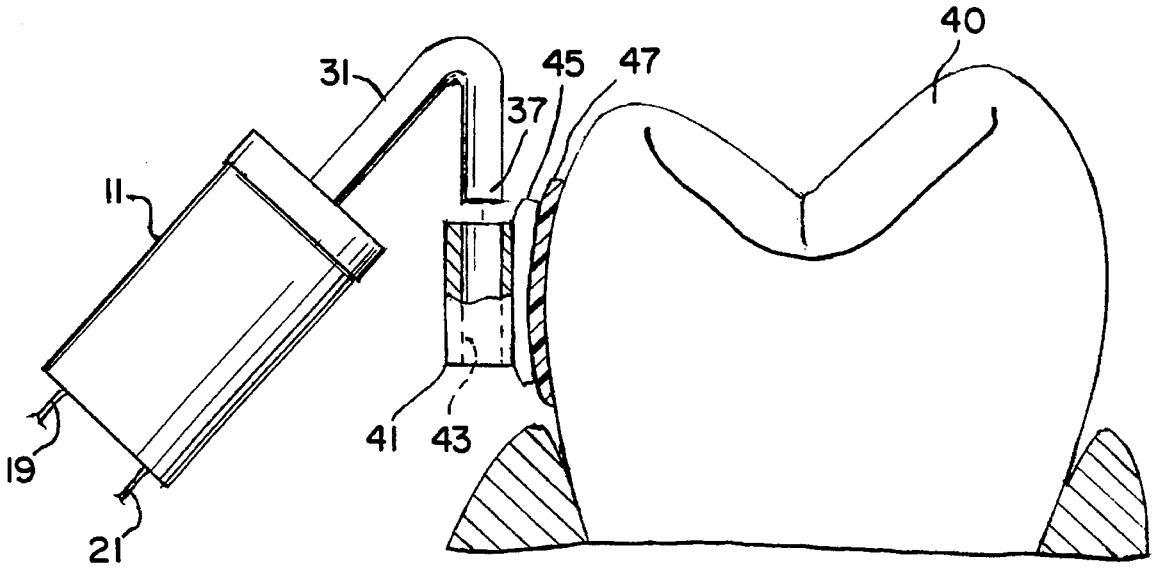
FIG. 4 is a diagrammatic side view of an arrangement for coupling the transducer of FIGS. 1 or 3 to hard tissue.
Figure 5:
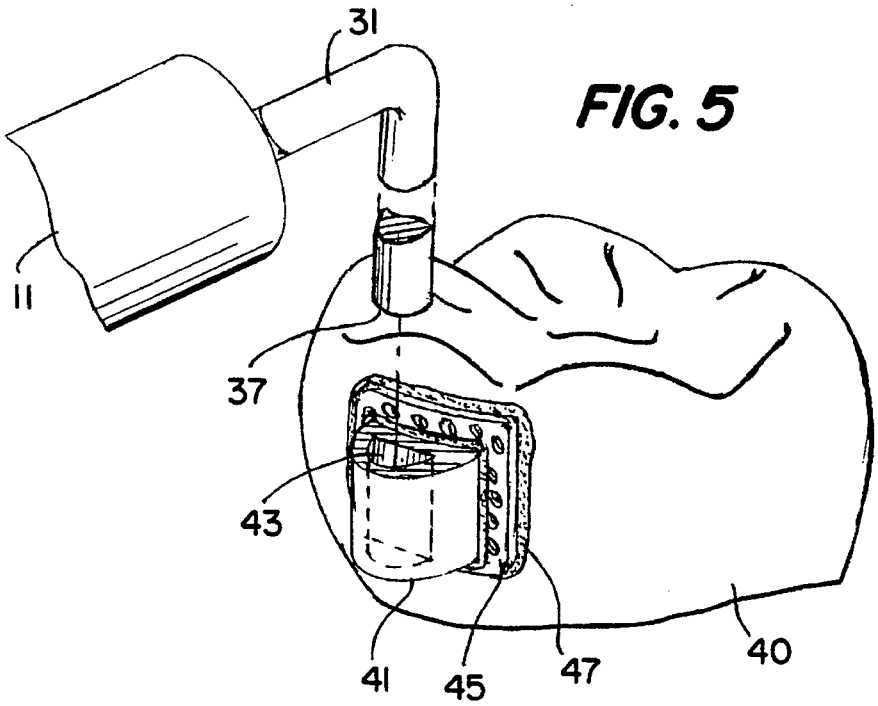
FIG. 5 is a view in perspective of the coupling arrangement of FIG. 4.

Referring specifically to FIGS. 4 and 5 of the accompanying drawings, transducer 30 is illustrated in conjunction with a maxillary molar tooth 40 to which vibrations are to be applied. Secured to the side wall of tooth 40 is an orthodontic bracket 41 having a receiver channel 43 defined therethrough longitudinally of tooth 40. Receiver channel 43 is configured to match the configuration of the distal end of driving rod 31 of transducer 30. In the preferred embodiment, and as illustrated in FIGS. 4 and 5, the transverse cross-sections of channel 43 and likewise of the distal end of rod 31 are D-shaped with the straight portion of the "D" disposed closest to the tooth wall. Driving rod 31 is bent at an angle determined by the mounting location of housing 11 to permit the distal end of the rod to be readily received in channel 43. Bracket 41 has its attachment surface secured to a perforated or sandblasted metal bonding pad 45, the opposite surface of which is secured to the side wall of tooth 40 by means of an adhesive resin 47 applied to a preconditioned portion of the tooth surface. For preconditioning, the tooth surface is typically etched before application of the adhesive resin 47 to assure secure engagement by the adhesive resin. In the preferred embodiment of the present invention, where the transducer is secured to a tooth, the preferred adhesive is a Bis-GMA type resin conventionally used for orthodontic applications. Where the hard tissue is bone, the preferred adhesive resin is hydroxyapatite cement, a non-ceramic cement produced by direct crystallization of hydroxyapatite in vivo. Such cement does not require heating for the formation of a structurally stable attachment. This cement is described in detail in an article entitled "Hydroxyapatite Cement" by Costantino, et al appearing in the "Archives of Otolaryngology—Head & Neck Surgery", Volume 117, April 1991, Pages 379–384. The subject matter of that article is incorporated herein in its entirety by this reference. The cement described therein is capable of setting within one hour. In addition, when placed into contact with viable bone or periosteum, this particular cement is replaced by bone as the attached structure is resorbed. This cement, like Bis-GMA resin, also has sufficient structural stability to transmit vibrations from rod 31 through bracket 41 to the bone or tooth 40 without failure of the adhesive bond.

The particular utilization of transducer 30 illustrated in FIGS. 4 and 5 is for a hearing aid, or hearing assistive device, whereby the current flowing through the coil 17 of the transducer is derived from acoustic signals converted in a conventional manner to electrical audio signals applied to wires 19 and 21. Specifically, wires 19 and 21 may be connected directly to an acoustic-to-electrical transducer, such as a microphone, or the like, conventionally used in hearing aids. Alternatively, the microphone may be located remotely along with a small radio (or other transmission medium) transmitter, and wires 19 and 21 may be connected to a receiver for the transmitted audio signal. In this audiodontic transducer application, housing 11 may be mounted in the mouth in any manner known in the prior art, either to a tooth, to an implant, as part of an orthodontic retainer, or in any conventional manner. Irrespective of the manner of mounting the container, the key feature of the coupling arrangement is the close sliding fit between the distal end 37 of rod 31 and the similarly configured channel 43 of orthodontic bracket 41. This close fitting relation permits vibrations to be efficiently transmitted to the tooth or to bone tissue while still permitting the transducer itself to be removed easily from bracket 41 when necessary.

Although the utilization shown in FIGS. 4 and 5 for transducer 30 is as an audiodontic hearing assistive device, it will be appreciated that the bracket 41 can be similarly attached to bone tissue at a surgical site, and that transducer 30 can be appropriately disposed at that site to impart vibrations to the bone for various therapeutic purposes.

The present invention has numerous advantages over prior art devices intended to apply vibrations to bone. To begin with, the magnetostrictive properties of rod 20 cause that rod to exhibit vibrations in the form of alternating dimensional changes. This is significantly different from devices providing vibration by electromagnetically translating a member having finite mass and inertia. Further, the vibrating member of the present invention can be removed from the hard tissue coupling site with minimal disruption to the surrounding tissue and the hard tissue itself. Only the precision female attachment bracket 41 is cemented to, and can become osseointegrated with the hard tissue. This female attachment bracket is made of a biologically inert substance and can therefore be left behind and reused latter, with a different transducer if necessary.

The invention can be utilized in a patient's mouth, as described, where removal of the transducer itself can occur on a daily basis, if desired. It can also be used, however, deep within the patient's body, such as on a broken femur. Soon after the break in such bone has occurred, the vibrator can be actuated by transmission of an appropriate signal through the skin to an on-site receiver for inducing current in winding 17. In other words, the actuation device for generating the electromagnetic field is located outside the body in such a situation. The transducer can also be located at a position remote from the fracture and take advantage of the fact that vibrations travel considerable distance through bone and other hard tissue. Thus, the transducer of the present invention, unlike prior art implantable electrical bone simulators, is not necessarily a foreign object at the fracture site that could possibly interfere with normal physiological healing.

It is to be noted that the female attachment bracket 41 is provided solely for mechanical purposes; that is, it is provided for the purpose of attachment to the vibrating member 31, not as an electrode to receive electrical current as in U.S. Pat. No. 5,033,999 (Mersky).

It will be appreciated that the present invention provides a method and apparatus capable of imparting controllable, reproducible vibrations into any human hard tissue or adjacent surrounding tissue. Moreover, the invention provides a unique means for attaching or coupling the transducer to hard tissue so that transduction of electrical or electromagnetical energy to mechanical energy occurs directly at the site of coupling. This direct coupling to the hard tissue site results in efficient conversion of electrical energy to vibrations in the tissue. That is not to say that the intended beneficial physiological effect of the vibrations provided by the present invention need be at the actual attachment site. In fact, the desired physiological effects may be intended for a target organ at some distant site from where the vibrations are applied. The ultimate effect of those vibrations depends on the target organ and also the physiological or biological events accruing therefrom. For example, it is well known that applying vibrations to bones of the human skull results in hearing at the organ of Corti. It is not as well known, however, what effect, if any, such vibrations have on the pituitary gland, for example. Furthermore, it is not currently known what, if any, specific frequency or intensity of sound produces a physiological effect on the pituitary gland. It may be necessary to utilize certain drugs in combination with stimulation by vibrations to boost hormonal release from the pituitary gland, etc.

It is known that vibrations can promote bone remodelling. The present invention provides a method and apparatus for applying such vibrations, perhaps again in combination with certain drugs, to possibly alter the hemopoietic abilities of certain long bones. In a fashion analogous to the treatment of damaged ligaments and bone joints with externally applied whirlpool baths, internal vibrations may promote healing more efficiently. Elaborating further, if a knee ligament is damaged in a sports accident, the orthopedist wants a short term approach for increasing the speed of ligament healing. Through arthroscopy it is possible to cement bracket 41 and attach a modified embodiment of transducer 30 to the bracket. That modified bracket would not include coil 17, thereby significantly reducing the overall size of the housing. Instead of the internal coil, an external coil may be applied outside the body to provide a magnetic field passing through the body and, more particularly, through the attached magnetostrictive rod. This obviously requires far more electrical power to produce the desired magnetic field, but since the coil is external and needs only be worn for short periods of time each day, this is a practical approach. After the ligament has healed, the physician can arthroscopically remove the transducer but may wish to leave the female tiny precision attachment bracket in place for future use.

Although the preferred embodiment of the present invention utilizes the unique coupling arrangement illustrated in FIGS. 4 and 5, the vibrations provided by the magnetostrictive rod 20 may be coupled to tissue in a variety of other ways, depending upon the particular situation. For example, the coupling member 29 in the embodiment of FIG. 1 can be placed in direct abutment with bone tissue or a tooth by using some other technique to position the transducer at the attachment site. For another example, member 20 can be threaded so as to be screwed directly into the bone or tooth. Alternatively, the transducer may be a component of an implantable prosthesis, such as a hip replacement prosthesis.

Although the illustrated embodiments of the invention have a coupler 29 or driving rod 31 at only one end of the assembly, it will be appreciated that some applications may benefit from couplers or driving rods at each end. Such an arrangement is within the scope of the invention described herein.

Having described preferred embodiments of a new and improved method and apparatus for imparting vibrations to bone and similar hard tissue in accordance with the present invention, it is believed that other modifications, variations and changes will be suggested to those skilled in the art in view of the teachings set forth herein. Accordingly, it is to be understood that all such variations, modifications and the changes are believed to fall within the scope of the present invention as defined by the appended claims.

What is claimed is:

1. A method for imparting low amplitude therapeutic vibrations to hard living tissue in a person's body, said method comprising the steps of:

(a) creating an electromagnetic field of varying amplitude;

(b) positioning a magnetostrictive rod in said electromagnetic field to produce alternating dimensional changes in said rod, said changes corresponding to amplitude changes in said electromagnetic field; and (c) imparting said alternating dimensional changes as vibrations to said hard tissue by placing an actuator in contact with said magnetostrictive rod to vibrate said actuator in response to said alternating dimensional changes, securing a bracket to said hard tissue and removably engaging said actuator in said secured bracket to impart vibrations from said actuator through said bracket to said hard tissue.

2. The method of claim 1 wherein step (c) includes slidably engaging said actuator and bracket in close-fitting relation.

3. The method of claim 1 wherein step (c) includes adhesively bonding said bracket to said hard tissue with an adhesive resin-based cement.

4. The method of claim 1 wherein step (c) includes adhesively bonding said bracket to said hard tissue with a non-ceramic hydroxyapatite cement.

5. The method of claim 1 wherein step (b) comprises positioning a $Te_{.27}Dy_{.75}Fe_2$ rod in said electromagnetic field.

6. The method of claim 1 wherein step (b) comprises positioning an elongate rod of said magnetostrictive material in said electromagnetic field such that the field extends longitudinally through said rod.

7. The method of claim 6 wherein step (a) includes passing electrical current of varying amplitude through an electrical coil having a hollow core to create said field extending longitudinally in said core; and wherein step (b) includes disposing said rod within said core.

8. The method of claim 7 further comprising the steps of:

(d) disposing said coil and rod in a magnetically permeable container; and (e) resiliently compressing said rod longitudinally within said container.

9. The method of claim 1 wherein said alternating electromagnetic field is created in response to acoustic signals, and wherein said vibrations are transmitted from said hard tissue to an ear of said person.

10. The method of claim 1 wherein said alternating electromagnetic field is at one or more predetermined frequencies, and wherein said hard tissue is a fractured bone to be healed by said vibrations.

11. Apparatus for imparting low amplitude therapeutic vibrations to hard living tissue in a person's body, said apparatus comprising:

a magnetostrictive rod responsive to a varying magnetic field passing therethrough for expanding and contracting in size in response to variations in said field;

an electrical coil responsive to variable amplitude electrical current passing therethrough for creating a varying electromagnetic field passing through said rod, thereby causing said rod to expand and contract in size with variations in the current amplitude;

an actuator in direct contact with said rod such that said actuator vibrates as a function of the size expansions and contractions of said rod; and bracket coupling means adapted to conduct vibrations from said actuator to said hard tissue wherein said actuator has a distal end with a predetermined configuration, wherein said coupling means comprises a bracket adapted to be secured to said tissue by non-ceramic cement, and wherein said bracket is removably secured to said distal end of said actuator in close fitting sliding engagement.

12. The apparatus of claim 11 wherein said bracket includes a receiver channel and said channel engages said distal end of said actuator in sliding engagement.

13. The apparatus of claim 11 wherein said magnetostrictive material is $Tb_{.27}Dy_{.73}Fe_2$.

14. The apparatus of claim 11 further comprising a magnetically permeable housing containing said coil, said rod and at least a portion of said actuator, wherein an additional portion of said actuator projects exteriorly of said housing.

15. The apparatus of claim 14 further comprising first and second permanent magnets disposed within said housing in contact with first and second ends, respectively, of said rod.

16. The apparatus of claim 15 further comprising at least one resilient member disposed within said housing longitudinally compressing said rod.

17. A method for imparting low amplitude therapeutic vibrations to hard living tissue in a person's body, said method comprising the steps of:

(a) creating an electromagnetic field of varying amplitude;

(b) positioning a magnetostrictive rod in said electromagnetic field to produce alternating dimensional changes in said rod, said changes corresponding to amplitude changes in said electromagnetic field; and (c) imparting via a bracket said alternating dimensional changes as low amplitude vibrations to said hard tissue.

18. The method of claim 17 wherein said low amplitude vibrations have amplitudes on the order of 0.010 mm.

* * * * *